US005625934A

United States Patent [19]

Kremer

[11] Patent Number: 5,625,934

[45] Date of Patent: May 6, 1997

[54] REELING METHOD WITH SCANNING OF MATRIX OF SENSORS

[75] Inventor: Hubert Kremer, Grefrath, Germany

[73] Assignee: Sucker-Muller-Hacoba GmbH & Co., Monchen-Gladbach, Germany

[21] Appl. No.: 605,390

[22] Filed: Feb. 22, 1996

[30] Foreign Application Priority Data

Feb. 23, 1995 [DE] Germany ..... 19506205.1

[51] Int. Cl.[6] ..... B65H 63/00; D02H 13/08

[52] U.S. Cl. ..... 28/187; 28/185; 139/353

[58] Field of Search ..... 28/190, 187, 185; 139/353, 351; 242/534

[56] References Cited

U.S. PATENT DOCUMENTS

| | | | |
|---|---|---|---|
| 4,169,981 | 10/1979 | White et al. | 28/187 |
| 4,566,163 | 1/1986 | Makino et al. | 28/187 |
| 4,976,018 | 12/1990 | Bollen | 28/187 |
| 5,165,454 | 11/1992 | Kanayama et al. | 139/351 |
| 5,313,692 | 5/1994 | Mizuuchi et al. | 28/187 |
| 5,446,951 | 9/1995 | Takeuchi et al. | 28/187 |

*Primary Examiner*—Andy Falik

*Attorney, Agent, or Firm*—Herbert Dubno; Andrew Wilford

[57] ABSTRACT

In a reeling machine a multiplicity of yarns are pulled from respective supplies and wound up on a beam and each yarn is associated with a sensor which produces an output whose state indicates if the respective yarn is broken or not present. Each sensor is periodically scanned to read the state of its output and the reeling machine is stopped when one of the scanned outputs corresponds to a broken or not present condition of the respective yarn. An output is simultaneously generated indicating exactly which yarn is broken or not present. The sensor are connected to a matrix and the matrix is scanned to read the sensor outputs.

11 Claims, 1 Drawing Sheet

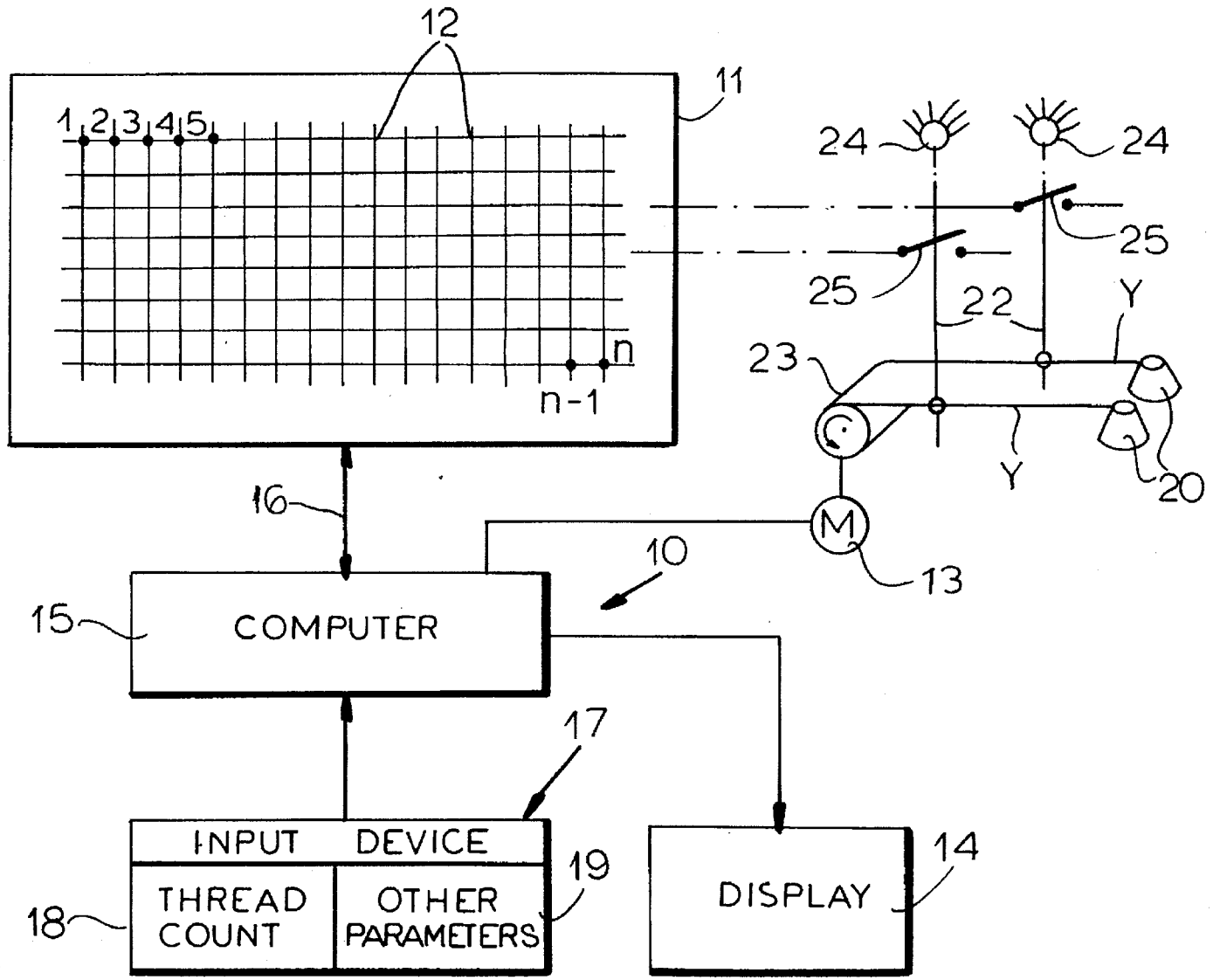
24
25
Y
20
22
Y
24
25
13
23
11
10
14
DISPLAY
n
n-1
12
17
19
DEVICE
OTHER PARAMETERS
1 2 3 4 5
16
COMPUTER
INPUT
THREAD COUNT
15
18

REELING METHOD WITH SCANNING OF MATRIX OF SENSORS

FIELD OF THE INVENTION

The present invention relates to a reeling machine. More particularly this invention concerns a method of and apparatus for operating a machine that winds yarns up on a warp beam or the like.

BACKGROUND OF THE INVENTION

A reeling machine typically has a beam or drum on which is wound a multiplicity of yarns for subsequently forming the warp of woven goods. The individual yarns are pulled from respective supplies on a creel. It is absolutely essential that each yarn be continuous, that is if any yarn breaks while forming the wound warp beam, the winding operation must be stopped so the break can be repaired or a new yarn can be knotted to the broken end before winding can be restarted.

Accordingly it is standard for each yarn to pass over various guides and through a respective eye of a vertical sensor wire. So long as the yarn is taut, the wire is lifted and a switch associated with it is held closed or open. If the yarn breaks, the sensor drops and changes the condition of its switch. If any of the switches moves to an undesired condition, the winding process is immediately shut down.

Normally the yarn supplies are held in the creel in banks, that is arranged in rows and columns. The sensors are similarly organized as the yarns eventually run so close to each other that they could not all be put in a straight line. When one of the yarns breaks a further sensing system can detect which bank the dropped sensor is in, so that the machine operator can find the broken yarn, repair it, and restart the machine. Finding the broken yarn takes some time, increasing the down time when a yarn breaks.

Capacitive sensors are also known which are automatically activated when the winding operation is started. In such a system the exact location of the broken yarn can indeed by ascertained. Nonetheless; even in this system it is a fairly complex job to program the device since it is rarely used at 100% capacity, that is with every possible sensor and creel holder in use. More often only a portion of the warp beam is used, a short warp is wound, or the yarns are widely spaced so some of the sensors are not used. In these cases the unused sensors must be individually disconnected, a job that takes again increases down time.

OBJECTS OF THE INVENTION

It is therefore an object of the present Invention to provide an improved system for operating a reeling machine, Another object is the provision of such an improved system for operating a reeling machine which overcomes the above-given disadvantages, that is which provides accurate information about any yarn that breaks, that is easy to set up, and that reduces down time in the event of a yarn break.

SUMMARY OF THE INVENTION

The instant invention is a method of operating a reeling machine wherein a multiplicity of yarns are pulled from respective supplies and wound up on a beam and each yarn is associated with a sensor which produces an output whose state indicates if the respective yarn is broken or not present. According to the invention each sensor is periodically scanned to read the state of its output and the reeling machine is stopped when one of the scanned outputs corresponds to a broken or not present condition of the respective yarn. An output is simultaneously generated indicating exactly which yarn is broken or not present.

It is important to the invention that a central controller monitors all the sensors. The individual sensors are scanned one after the other so that periodically all the information needed corresponding to every sensor is derived. Since absolutely every sensor is scanned, any chance of error is eliminated. Although with a large loom system several thousand such sensors must actually be scanned, this can be done very rapidly with today's electronic technology so that no significant time is lost, even for stopping a rapidly rotating take-up beam before the loose end is wound into the lay of warp on the beam.

While it is in theory irrelevant for serial scanning how the information gets into the control means, it is possible to connect the controller directly to each and every sensor. Alternately a matrix is provided between the controller and the sensors to simplify connections and speed readout.

Since it is common to use only a portion of a warp beam, when making goods of less than the maximum width, according to the invention the controller determines which sensors are being used for a given reeling operation and only scans the used sensors and ignores the remaining sensors so that the states of unused sensors are ignored. Thus the operator inputs the number of the highest-number sensor being used, and the sensors with higher numbers are ignored, speeding the scanning operation.

In the reeling method of this invention the output indicating which yarn is generated at the respective yarn. A visual or acoustic alarm can be provided right on the sensor, making finding it very easy.

Furthermore according to the invention the output indicating which yarn is broken or not present indicates a level of the yarn supply. It also gives the exact number or position of the yarn. This allows the operator to quickly determine where the problem is, since the banks of the creel are easily visible.

In accordance with a further feature of the invention prior to starting the reel machine the outputs of the sensors are scanned and startup of the machine is prevented if any of the outputs indicates the respective yarn is broken or not present. This is very convenient in that it allows the controller to verify that the reeling machine has been properly setup from the start. If a yarn is missing or broken, the machine cannot be started. Once again, the controller is programmed to ignore sensors that are not supposed to be used, although according to a further feature of this invention even these sensors can be scanned to make sure that the respective eyes are indeed empty. Such electronic verification is extremely fast and accurate, eliminating a time-consuming inspection of the machine before starting it.

In order to speed the system the scanning is done by groups of sensors and several groups are scanned simultaneously. Each group can correspond to one level or bank of the creel.

According to the invention winding of the filaments on the beam is controlled in accordance with how many sensors are scanned. More specifically more winding torque or more radial roller pressure is used for more yarns and vice versa, the machine automatically determining the right amount of force. The operator inputs the gauge and number of yarns, and the machine can automatically set the appropriate feed rate, torque, and/or roller pressure.

As a further process-control step according to the invention the outputs of the sensors are added together and stored from one creeling operation to the next. If it is determined that a yarn associated with a particular sensor is breaking regularly, the associated supply and guides can all be check to eliminate this problem.

The apparatus according to the invention has according to the invention a beam, means for pulling a multiplicity of yarns from respective supplies and winding them up on the beam, and a sensor associated with each yarn which produces an output whose state indicates if the respective yarn is broken or not present. A matrix is connected to the sensors and a controller is connected to the matrix for periodically scanning each sensor and reading the state of its output. The controller stops the reeling machine when one of the scanned outputs corresponds to a broken or not present condition of the respective yarn. It also generates an output indicating exactly which yarn is broken or not present so the problem can be corrected.

The controller includes a register having an address corresponding to each of the sensors. Prior to starting the reeling machine those addresses corresponding to the sensors associated with yarns are loaded with a signal indicating they are to be used and the other addresses are loaded with a value indicating they are not to be used. Then with each scan of the sensors the value read from the sensor is compared with the value in its register address and., if there is a difference, the machine is stopped. This system also can prevent the machine from being started unless it is properly loaded.

BRIEF DESCRIPTION OF THE DRAWING

The above and other objects, features, and advantages will become more readily apparent from the following description, reference being made to the accompanying drawing whose sole FIGURE is a diagrammatic view illustrating the method and apparatus of the invention.

SPECIFIC DESCRIPTION

As seen in the drawing a controller 10 is provided for a winding or reeling machine comprised of a warp beam 23 that pulls yarns Y off respective supplies 20 (only two shown) arranged in rows and columns in a standard creel. The yarns Y pass through eyes of vertically displaceable sensor wires 22 associated with respective switches 25 and respective signal lights 24.

The controller 10 comprises a computer 15 provided with a memory and connected at 16 for bidirectional communication with a matrix 11 having points 12 connected to the sensors 22 here arranged in banks or levels and numbered 1 through n. The computer 15 can receive input from a device 17 that receives data about the thread count at 18 and other parameters at 19. The computer 15 is connected to a drive motor 13 of the take-up beam 23 and to a display 14 which may incorporate a printer. In addition each sensor 22 is associated with a visual alarm, here in the form of the tiny pilot light 24 mounted right on the sensor 22 and these lights 24 are also connected via an unillustrated line to the computer 15 for energization thereby.

The memory of the computer 15 has a register with an address dedicated to each of the sensors 22 via the respective point 12 on the matrix 11. Prior to startup the thread count is inputted at 18 so that each address of the register is loaded with a value corresponding to whether the respective sensor is supposed to produce an on or off signal, corresponding to whether or not it is supposed to be loaded with a yarn Y. The computer 15 periodically polls all the points 12 to determine the states of the sensor switches 25 and will only allow the system to start when all those switches 25 that are supposed to be closed are closed and all those that are supposed to be open are indeed open. Thus the system of this invention monitors that the warp lay is correct, saving the machine operator the laborious task of checking and rechecking the threading of the eyes of the sensors 22.

Once the machine is running the computer 15 continues to periodically (actually many times a second) poll the matrix points 12 to ascertain that none of the yarns Y has broken, which will be indicated when the respective switch 25 changes state. The scanned state of each switch 25 is compared with the information in the respective register of the computer's memory. If the comparison shows a difference, indicating a yarn has broken, the computer 15 immediately shuts down the drive motor 13 and thereby stops the process. At the same time it indicates on the display 14 the exact location of the broken filament, not just the bank or level it is in as with the prior art, and can simultaneously also light up the signal light 24 provided right on the sensor 22 of the broken yarn Y so the operator can find and tend to it, knotting on a new yarn end.

In addition the computer 15 can use the information obtained from the input device 17, that is the number of yarns, the dtex number of the yarns, and so on, to set the tension in these yarns Y either by driving the motor 13 to achieve the desired torque or operating unillustrated thread brakes to create the desired tension in the yarns. The more filaments there are, the more torque can be applied by the motor 13 without any danger of breaking a yarn from tension alone.

I claim:

1. A method of operating a reeling machine wherein a multiplicity of yarns are pulled from respective supplies and wound up on a beam, the method comprising the steps of:

providing each yarn with a sensor which produces an electrical sensor output whose state indicates if the respective yarn is broken or not present;

periodically electrically scanning each sensor and reading the state of its output;

automatically stopping the reeling machine when one of the scanned outputs corresponds to a broken or not present condition of the respective yarn; and generating a yarn-identifying output indicating exactly which yarn is broken or not present.

2. The reeling method defined in claim 1 further comprising the step of determining which sensors are being used for a given reeling operation and only scanning the used sensors and ignoring the remaining sensors, whereby the states of unused sensors are ignored.

3. The reeling method defined in claim 1 wherein the yarn-identifying output indicating which yarn is broken or not present indicates a level of the yarn supply.

4. The reeling method defined in claim 1, further comprising prior to starting the reeling machine the step of:

scanning the sensor outputs and preventing startup of the machine if any of the sensor outputs indicates the respective yarn is broken or not present.

5. The reeling method defined in claim 4, further comprising the step when only a portion of the sensors are being used for a job, of scanning all of the sensors prior to startup of the machine.

6. A method of operating a reeling machine wherein a multiplicity of yarns are pulled from respective supplies and wound up on a beam, the method comprising the steps of:

providing each yarn with a sensor which produces a sensor output whose state indicates if the respective yarn is broken or not present;

connecting the sensors to a matrix and scanning the matrix to read the states of the sensor outputs;

stopping the reeling machine when one of the scanned sensor outputs corresponds to a broken or not present condition of the respective yarn; and generating a yarn-identifying output indicating exactly which yarn is broken or not present.

7. A method of operating a reeling machine wherein a multiplicity of yarns are pulled from respective supplies and wound up on a beam, the method comprising the steps of:

providing each yarn with a sensor which produces a sensor output whose state indicates if the respective yarn is broken or not present;

periodically scanning each sensor and reading the state of its output;

stopping the reeling machine when one of the scanned outputs corresponds to a broken or not present condition of the respective yarn; and generating a yarn-identifying output indicating exactly which yarn is broken or not present at the respective yarn.

8. A method of operating a reeling machine wherein a multiplicity of yarns are pulled from respective supplies and wound up on a beam, the method comprising the steps of:

providing each yarn with a sensor which produces a sensor output whose state indicates if the respective yarn is broken or not present;

periodically scanning each sensor by groups of sensors and several groups are scanned simultaneously and reading the state of their outputs;

stopping the reeling machine when one of the scanned outputs corresponds to a broken or not present condition of the respective yarn; and generating a yarn-identifying output indicating exactly which yarn is broken or not present.

9. A method of operating a reeling machine wherein a multiplicity of yarns are pulled from respective supplies and wound up on a beam, the method comprising the steps of:

providing each yarn with a sensor which produces a sensor output whose state indicates if the respective yarn is broken or not present;

periodically scanning each sensor and reading the state of its output;

stopping the reeling machine when one of the scanned outputs corresponds to a broken or not present condition of the respective yarn;

generating a yarn-identifying output indicating exactly which yarn is broken or not present; and controlling winding of the yarns on the beam in accordance with how many sensors are scanned.

10. A method of operating a reeling machine wherein a multiplicity of yarns are pulled from respective supplies and wound up on a beam, the method comprising the steps of:

providing each yarn with a sensor which produces a sensor output whose state indicates if the respective yarn is broken or not present;

periodically scanning each sensor and reading the state of its output;

stopping the reeling machine when one of the scanned outputs corresponds to a broken or not present condition of the respective yarn;

generating a yarn-identifying output indicating exactly which yarn is broken or not present; and adding together and storing the sensor outputs.

11. A reeling apparatus comprising:

a beam;

means for pulling a multiplicity of yarns from respective supplies and winding them up on the beam;

means associated with each yarn including a respective sensor which produces a sensor output whose state indicates if the respective yarn is broken or not present;

a matrix connected to the sensors;

means connected to the matrix for periodically scanning each sensor and reading the state of its output;

control means for stopping the reeling machine when one of the scanned sensor outputs corresponds to a broken or not present condition of the respective yarn; and means for generating a yarn-identifying output indicating exactly which yarn is broken or not present.

* * * * *